United States Patent [19]

Bougle

[11] Patent Number: 4,720,844

[45] Date of Patent: Jan. 19, 1988

[54] HIGH-VOLTAGE GENERATING ASSEMBLY AND AN X-RAY DEVICE

[75] Inventor: Jean Bougle, Meudon, France

[73] Assignee: Thomson-CGR, Paris, France

[21] Appl. No.: 841,319

[22] Filed: Mar. 19, 1986

[30] Foreign Application Priority Data

Mar. 22, 1985 [FR] France ..... 8504337

[51] Int. Cl.[4] ..... H05G 1/10

[52] U.S. Cl. ..... 378/101; 378/104; 363/61

[58] Field of Search ..... 378/101, 102, 107, 104, 378/109, 110, 111, 112; 363/61

[56] References Cited

U.S. PATENT DOCUMENTS

| | | | |
|---|---|---|---|
| 2,611,096 | 9/1952 | Wright et al. | 378/112 |
| 3,842,280 | 10/1974 | Herrick | 378/110 |
| 4,295,049 | 10/1981 | Ebersberger et al. | 378/110 |
| 4,400,822 | 8/1983 | Kühnke et al. | 378/101 |

FOREIGN PATENT DOCUMENTS

| | | | |
|---|---|---|---|
| 0003946 | 9/1979 | European Pat. Off. . | |
| 0063183 | 10/1982 | European Pat. Off. . | |
| 1384648 | 11/1964 | France . | |
| 2516336 | 5/1983 | France . | |
| 608646 | 3/1947 | United Kingdom . | |
| 0851803 | 7/1987 | U.S.S.R. | 378/102 |

OTHER PUBLICATIONS

GEC Journal, vol. 16, No. 10, Oct. 1949, pp. 175–183, Wembley, GB; D. H. Donaldson, et al: "A 250 Kilovolt X-ray Equipment for Deep Therapy", *pp. 177–178; figures 3 and 4*.

*Primary Examiner*—Janice A. Howell
*Assistant Examiner*—David P. Porta
*Attorney, Agent, or Firm*—Oblon, Fisher, Spivak, McClelland & Maier

[57] ABSTRACT

An assembly consisting of a high-voltage generator and an X-ray device comprises a shield housing containing an X-ray tube supplied with high voltage by a high-voltage generator. The high-voltage generator comprises a step-up transformer which is located outside the shield housing and supplies a voltage-multiplier device mounted within the housing.

8 Claims, 2 Drawing Figures

HIGH-VOLTAGE GENERATING ASSEMBLY AND AN X-RAY DEVICE

BACKGROUND OF THE INVENTION

1. Field of the Invention

The invention relates to an assembly comprising a high-voltage generator and X-ray device for use in the general field of radiology.

2. Description of the Prior Art

In order to produce x-radiation, certain installations comprise a so-called X-ray unit. This term is usually understood to mean a device comprising, within a single enclosure referred-to as a shield housing, an X-ray tube for producing x-radiation and means for generating on the one hand the high-voltage supply which is applied to the anode and to the cathode of said X-ray tube and on the other hand the voltages for heating the filament or filaments with which the cathode is equipped. The high voltage is obtained from an alternating-current low voltage which is conveyed to the interior of the shield housing via low-voltage leads and applied to a high-voltage transformer. The alternating-current high voltage developed by said transformer is applied to the anode and to the cathode either directly or via a rectifying device, depending on the type of operation which is contemplated. The voltage used for heating the cathode filament is obtained from one or two low-voltage transformers which are in turn supplied, for example, by means of leads which carry the alternating-current low voltage.

An arrangement of this type usually applies to relatively low values of power consumed by the X-ray tube (values substantially equal to or lower than 50 KW). In the case of higher-power assemblies, the general arrangement is usually different and consists in separating the high-voltage generator from the X-ray tube or in other words placing the high-voltage generator outside the housing. In this design, the high-voltage generator is connected to the X-ray tube by means of wires constituting a pair of high-voltage cables. At least one of these high-voltage cables is of the type which provides high electrical insulation resistance by reason of the fact that the high voltage applied between the cathode and the anode of the X-ray tube may have a high value (of the order of 80 to 150 KV).

One of the advantages offered by an X-ray unit with respect to the system constituted by a high-voltage generator located outside the shield housing lies in the fact that it does not entail any need to provide electric cables having high insulation resistance. Thus only a few low-voltage insulated leads are necessary for the purpose of supplying power to a unit of this type. It is indeed a fact that, in an X-ray installation, the housing which contains the X-ray tube is a particularly mobile element and the cable such as a high-insulation-resistance cable which is attached to the housing constitutes a considerable bulk by reason of the relatively rigid structure made necessary by its electrical insulation properties. Furthermore, although cables having high insulation resistance (dielectric strength) are commonly employed in the X-ray equipment industry, they are in fact very costly. The capital outlay involved is increased even further by the special connecting means required by a cable of this type at the point of penetration into the housing.

The X-ray unit is nevertheless subject to disadvantages since the weight and bulk of this unit are greater than those of the assembly consisting of the housing which contains the X-ray tube alone. This gives rise in particular to mechanical problems in the design of X-ray examination tables or other systems which are to be equipped with said unit.

SUMMARY OF THE INVENTION

This invention relates to an assembly comprising a high-voltage generator and X-ray unit, the novel arrangement of which leads to a significant reduction in weight and bulk of the X-ray device while retaining the simplicity of the conventional X-ray unit, this result being primarily due to the fact that a cable having high insulation resistance is no longer required.

The invention is accordingly directed to an assembly consisting of a high-voltage generator and X-ray device, and comprising a shield housing containing an X-ray tube which is supplied with high voltage by the high-voltage generator. Said generator comprises a step-up transformer supplied from a low-voltage source which delivers an alternating-current low voltage. The distinctive feature of the invention lies in the fact that said high-voltage generator further comprises at least one voltage-multiplier device which is mounted within said shield housing and delivers the high voltage to the X-ray tube. The aforementioned step-up transformer is placed outside said shield housing and generates an intermediate alternating-current high voltage. Said step-up transformer is connected to the voltage-multiplier device by means of a first conductor and a second conductor which carry said intermediate alternating-current high voltage.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
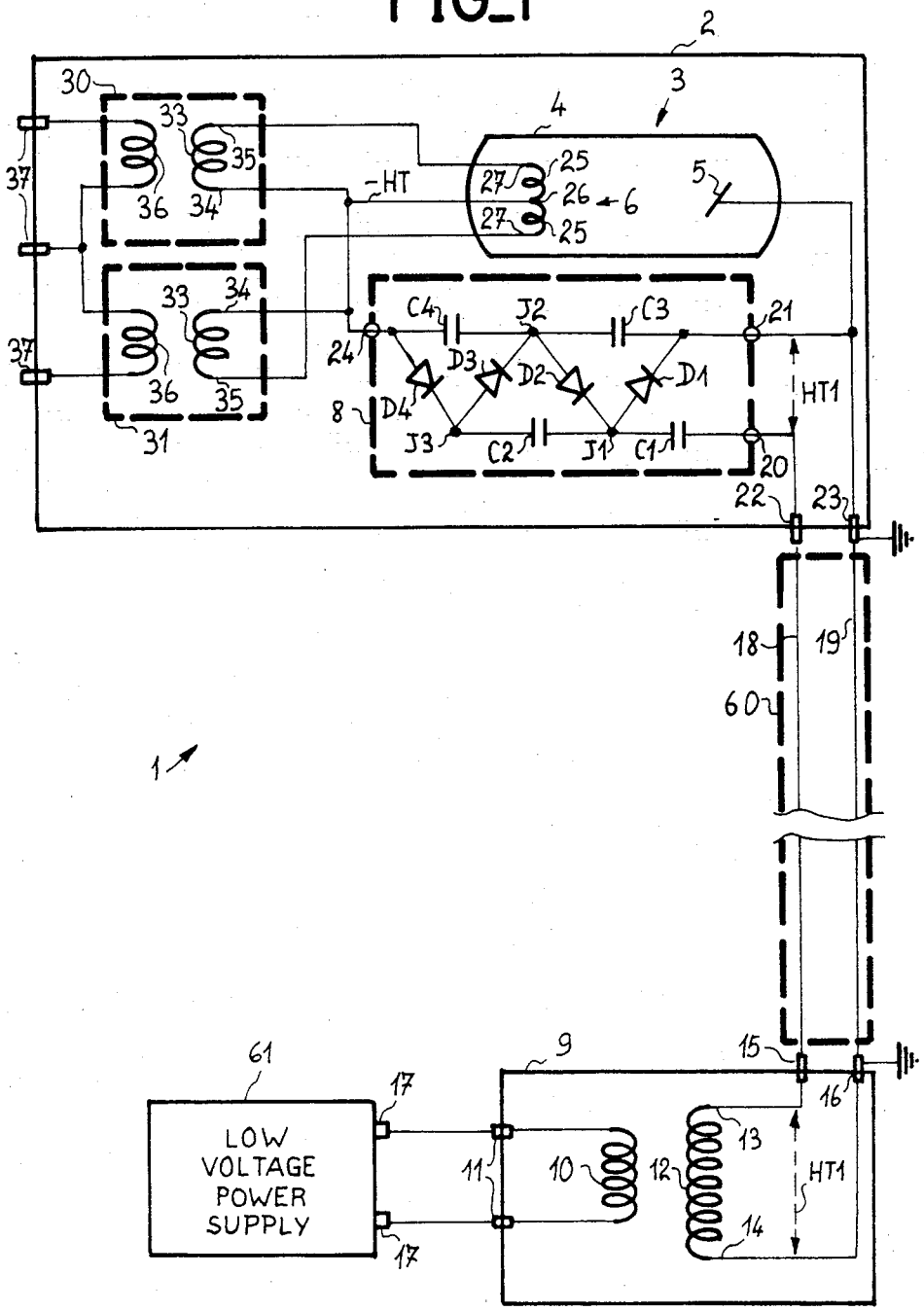
FIG. 1 is a schematic circuit diagram showing a first preferred embodiment of an assembly comprising a high-voltage generator and x-ray device in accordance with the invention.

As shown in the diagram of FIG. 1, the assembly 1 consisting of a high-voltage generator and X-ray device comprises a shield housing 2 and an X-ray tube 3 contained within said housing. Said X-ray tube is of conventional design and is represented in the figure by an envelope 4 containing an anode 5 and a cathode 6. The shield housing 2 and the X-ray tube 3 constitute an X-ray device which produces a beam of x-radiation (not shown) at the anode 5 when the X-ray tube 3 is in operation. The anode 5 can be either of the fixed-anode type or of the rotating-anode type.

In accordance with the invention, the shield housing 2 further contains a voltage-multiplier device 8 as shown within a dashed-line rectangle. The voltage-multiplier device constitutes an element of a high-voltage generator 8–9 which is mainly constituted by the voltage-multiplier device 8 and by a step-up transformer 9 placed outside the shield housing 2. The step-up transformer 9 comprises on the one hand a primary winding 10, each end of which is connected to a low-voltage input 11, and comprises on the other hand a secondary winding 12, the ends 13, 14 of which are connected respectively to a first output 15 and to a second output 16.

The low-voltage inputs 11 of the step-up transformer 9 are each connected to a low-voltage output 17 of an alternating-current low-voltage source 61. The low-voltage source 61 generates an alternating-current low voltage (not shown) which is applied to the primary winding 10 of the step-up transformer 9. Said step-up transformer 9 delivers via its secondary winding 12 an intermediate alternating-current high voltage HT1. The intermediate high voltage HT1 is applied to a first high-voltage input 20 and to a second high-voltage input 21 of the voltage-multiplier device 8. To this end, the first output 15 is connected to the first high-voltage input 20 by means of a first conductor 18 via a first connecting terminal 22 located at the level of the shield housing 2. The second output 16 is connected to the second high-voltage input 21 by means of a second conductor 19 via a second connecting terminal 23. In the example under consideration, the connection between the second output 16 and the second high-voltage input 21 is grounded.

In the first embodiment of the invention which is described solely by way of example, the ground constitutes the positive polarity of the high-voltage supply to the X-ray tube 3, the anode 5 of this latter being connected to the second high-voltage input 21 which is in turn brought to ground potential. The cathode 6 is of conventional type and comprises for example two filaments 25 having a common point 26 connected to a negative high-voltage output 24 of the voltage-multiplier device 8 which delivers the negative polarity −HT of the high voltage. In the example under consideration, the filaments 25 are each supplied by means of a first insulating transformer 30 and a second insulating transformer 31. Each transformer has a secondary winding 33, a first side 34 of which is connected to the common point 26 or −HT. The second sides 35 of said secondary windings 33 are connected to the second ends 27 of the filaments 25. The insulating transformers 30, 31 comprise primary windings 36 which are connected to terminals 37 and are supplied via said terminals with heating low voltage delivered by conventional means (not shown in the drawings) which are located outside the shielding housing 2.

The voltage-multiplier device 8 is of a type known per se. In the example under consideration, the voltage-multiplier device 8 makes it possible to obtain between the second high-voltage input 21 (or ground) and the negative high-voltage output 24 (−HT) a value of high voltage substantially equal to four times a value of the peak voltage (not shown) of the intermediate high voltage HT1. The high voltage thus generated by the voltage-multiplier device 8 is rectified and filtered.

In the embodiment herein described by way of example but not in any limiting sense, the voltage-multiplier device 8 comprises first, second, third and fourth rectifiers D1, D2, D3, D4 represented as diodes in the figure, and first, second, third and fourth capacitors C1, C2, C3, C4. The first rectifier D1 is connected by its cathode to the second high-voltage input 21 and by its anode to the cathode of the second rectifier D2 at a first junction point J1. The second rectifier D2 is connected by its anode to the cathode of the third rectifier D3 at a second junction point J2. The anode of the third rectifier D3 is connected at a third junction point J3 to the cathode of the fourth rectifier D4, the anode of which is connected to the negative high-voltage output 24 which delivers the negative polarity −HT of the high voltage. The first capacitor C1 is connected between the first high-voltage input 20 and the first junction J1. The second capacitor C2 is connected between the first junction J1 and the third junction J3. The third capacitor C3 is connected between the second high-voltage input 21 and the second junction point J2. The fourth capacitor C4 is connected between the second junction point J2 and the negative high-voltage output 24. Under these conditions, a first voltage appearing at the terminals of the second capacitor C2 is substantially equal to twice the value of the peak voltage of the intermediate alternating-current high voltage HT1 and a second voltage appearing at the terminals of the fourth capacitor C4 is substantially equal to twice said peak voltage value, said second voltage being added to the first. The high voltage applied to the X-ray tube 3 is thus substantially four times the peak value of the intermediate high voltage HT1 delivered by the step-up transformer 9 as mentioned earlier.

In accordance with one of the objectives of the present invention, the arrangement described in the foregoing makes it possible to connect the step-up transformer 9 to the voltage-multiplier device 8 contained in the shield housing 3 by making use of conductors 18, 19 contained in a cable 60 having considerably lower electrical insulation properties than those required in the prior art for the purpose of connecting a high-voltage generator located outside the shield housing to an X-ray tube within said housing when the level of high voltage required for the supply of the X-ray tube is delivered directly by said high-voltage generator.

It is in fact worthy of note that, beyond certain values of rated insulation voltage which the electric cables are designed to withstand (20 KV, for example), the different methods and materials employed in the manufacture of these cables lead to very high costs and to the production of cables having large cross-sectional areas and high mechanical rigidity, that is to say low flexibility. Such rigidity is in fact incompatible with the mobility which must be afforded by a shield housing containing an X-ray tube in a conventional diagnostic radiology installation. A further point to be considered is that, when the high voltage of an X-ray tube is delivered directly by a high-voltage generator at a high value, the connecting means between the high-voltage cables and the shield housing are also very cumbersome as well as very costly.

In the case of the present invention, the dimensions (not shown) of the shield housing 2 must make it possible to accommodate the voltage-multiplier device 8, with the result that the overall size of the housing may be larger than that of a housing in an installation in which the high-voltage generator delivers the high voltage directly. In contrast, the overall size of the step-up transformer 8 itself is smaller than in the prior art. Moreover, in the configuration provided by the invention, the overall size of the voltage-multiplier device 8 itself can be considerably reduced by increasing the operating frequency or in other words by increasing the frequency of the alternating-current low voltage (not shown) delivered by the low-voltage source 61. This low-voltage source 61 can be either the main power system (50-cycle or 60-cycle system) or else an inverter of a well-known type in standard use which is supplied from a direct-current source in a conventional manner (not shown in the drawings) and delivers the low voltage at a higher frequency of the order of 5 to 50 KHz, for example. It is thus possible to reduce the volume of a capacitor C1 to C4 in a manner which is substantially proportional to the increase in frequency of the alternating-current low-voltage supply.

This description of the first embodiment of the invention relates to the high-voltage supply of the single-pole X-ray tube 3, the anode 5 of which is connected to ground as well as the second high-voltage input 21 of the voltage-multiplier device 8 and the second output 16 of the step-up transformer 9. The first output 15 of the step-up transformer 9 is connected by means of the first conductor 18 to the first high-voltage input 20 of the voltage-multiplier device 8 which produces the supply high-voltage from the intermediate alternating-current high voltage HT1 and delivers the negative high-voltage −HT which is applied to the cathode 6.

Figure 2:
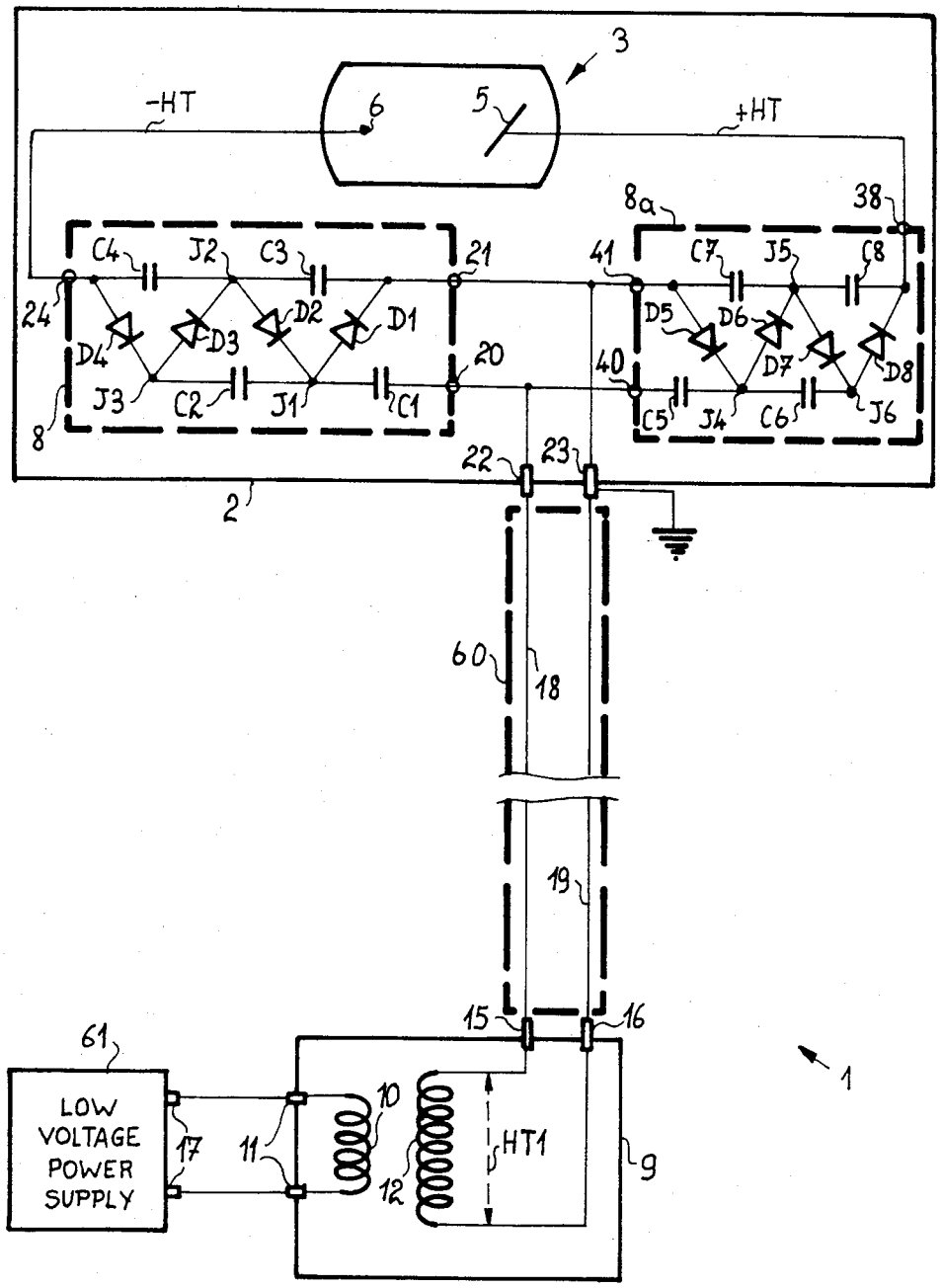
FIG. 2 is a schematic circuit diagram showing a second preferred embodiment of an assembly comprising a high-voltage generator and X-ray device in accordance with the invention.

FIG. 2 is a schematic diagram illustrating a second embodiment of the invention in which the X-ray tube 3 is supplied with high voltage in a bipolar mode.

As in the previous embodiment, the step-up transformer 9 delivers the intermediate high voltage HT1 via its first and second outputs 15, 16. The first output 15 is connected by means of the first conductor 18 to the first input 20 of the voltage-multiplier device 8. In the description which now follows, this device will be designated as the first voltage-multiplier device 8. The second output 16 of the step-up transformer 9 is connected to ground and to the second high-voltage input 21 of the first voltage-multiplier device 8. In this embodiment of the invention, the shield housing 2 contains, in addition to the first voltage-multiplier device 8, a second voltage-multiplier device 8*a* of a type similar to the first in the non-limitative example under consideration. The high-voltage supply to the X-ray tube 3 is produced by the two voltage-multiplier devices 8, 8*a* from the alternating-current high voltage HT1. The first voltage-multiplier device 8 produces with respect to ground the negative high voltage −HT which is applied to the cathode 6. The second voltage-multiplier device 8*a* produces with respect to ground the positive high voltage +HT which is applied to the anode 5.

The second voltage-multiplier device 8*a* constitutes with respect to ground a circuit arrangement which is symmetrical with that of the first voltage-multiplier device 8, the intermediate alternating-current high voltage HT1 being applied simultaneously to the two voltage-multiplier devices 8, 8*a*. The second voltage-multiplier 8*a* comprises a third and a fourth high-voltage input 40, 41 and a positive high-voltage output 38 which delivers the positive polarity +HT of the high-voltage supply of the X-ray tube 3. The third and fourth high-voltage inputs 40, 41 correspond respectively to the first and second inputs 20,21 of the first voltage-multiplier device 8 and have the same function as these latter. The third high-voltage input 40 is connected to the first conductor 18 and to the first high-voltage input 20, and the fourth high-voltage input 41 is connected to ground and to the second input 21 of the first voltage-multiplier device 8. The second voltage-multiplier device 8*a* comprises fifth, sixth, seventh and eighth rectifiers D5, D6, D7, D8 and fifth, sixth, seventh and eighth capacitors C5, C6, C7, C8, the circuit arrangement of which is equivalent to that of the first voltage-multiplier device 8 except for the fact that the rectifiers D5, D6, D7, D8 are oriented with respect to ground so as to have polarities which are opposite to those of the rectifiers D1, . . . D4. In fact, the rectifiers D1 to D4 on the one hand and the rectifiers D5 to D8 on the other hand are mounted in series so that the negative half-waves are conducted with respect to ground in the case of the rectifiers D1 to D4 of the first voltage-multiplier device 8 and so as to conduct the positive half-waves in the case of the rectifiers D5 to D8 of the second voltage-multiplier device 8*a*. In this seciond device, the fifth rectifier D5 is connected by its anode to the fourth high-voltage input 41 and by its cathode to the anode of the sixth rectifier D6 at a fourth junction point J4. The cathode of the sixth rectifier D6 is connected to the anode of the seventh rectifier D7 at a fifth junction point J5. The cathode of the seventh rectifier D7 is connected at a sixth junction point J6 to the anode of the eighth rectifier D8, the cathode of which is connected to the positive high-voltage output 38. The fifth capacitor C5 is connected between the third high-voltage input 40 and the fourth junction J4. The sixth capacitor C6 is connected between the fourth junction J4 and the sixth junction J6. The seventh capacitor C7 is connected between the fourth high-voltage input 41 and the fifth junction J5. The eighth capacitor C8 is connected between the fifth junction J5 and the positive high-voltage output 38.

In this configuration and in the case of a given high-voltage supply to the X-ray tube 3, the peak voltage (not shown) of the intermediate alternating-current high voltage HT1 is substantially eight times smaller ($\frac{1}{8}$) than the high voltage applied between the anode 5 and the cathode 6 of the X-ray tube 3. In the example shown in FIG. 2, the cathode 6 is represented schematically by a dot but may have either one or two filaments (not shown) as in the example of FIG. 1. These filaments can be supplied in the same manner as in the previous example.

The voltage-multiplier devices 8, 8*a* are of a type which is already known per se and make it possible in each case to multiply in a ratio of 4 the alternating-current high voltage HT1 which is applied to their inputs 20, 21 and 40, 41. Depending on the type of operation to be performed and the technology to be employed, this multiplication ratio can be modified by changing the number of stages of these voltage multipliers 8, 8*a*. By way of example, one stage is formed in the first voltage-multiplier device 8 by the fourth rectifier D4 which cooperates with the fourth capacitor C4.

The foregoing description constitutes only an example of an assembly 1 comprising a high-voltage generator and an X-ray device, and should therefore not be interpreted in a limiting sense. In this assembly, an electric cable 60 containing the first conductor 18 and the second conductor 19 carries an insulation voltage of considerably lower value than the high voltage supplied to the X-ray tube 3, namely one-quarter of said supply high-voltage in the example relating to FIG. 1 and only one-eighth of this high voltage in the example provided by the second embodiment of the invention.

What is claimed is:

1. An assembly comprising:

a high-voltage generator and x-ray device, a shield housing which forms an enclosure for said X-ray device and contains an X-ray tube having an anode and a cathode; said X-ray tube being supplied with high voltage by said high-voltage generator, said generator having a step-up transformer supplied from a low-voltage source which delivers an alternating-current low voltage, wherein said high-voltage generator further comprises at least one voltage-multiplier device which is mounted within said shield housing and delivers said high voltage to said X-ray tube, said step-up transformer being placed outside said shield housing for generating an intermediate alternating-current high voltage, said step-up transformer being connected to said voltage-multiplier device by means of a first conductor and a second conductor which carry only said intermediate alternating-current high voltage.

2. An assembly according to claim 1, wherein said first and second conductors are contained within an electric cable, the insulation voltage of said cable being of lower value than the high voltage supplied to the X-ray tube aforesaid.

3. An assembly according to claim 1, wherein said low-voltage source is an inverter.

4. An assembly according to claim 1, wherein said step-up transformer delivers said intermediate alternating-current high voltage via a first output and a second output connected respectively to a first high-voltage input and to a second high-voltage input of said voltage-multiplier device, said second high-voltage input being connected to the anode of said X-ray tube and to ground, said voltage-multiplier device being provided with a first high-voltage output connected to the cathode of said X-ray tube and delivering the negative polarity of said high voltage.

5. An assembly according to claim 1, wherein said voltage generator further comprises a second voltage-multiplier device mounted within said shield housing and cooperating with said first voltage-multiplier device in order to generate said high voltage from said intermediate alternating-current high voltage.

6. An assembly according to claim 5, wherein said first voltage-multiplier device delivers via a negative high-voltage output a negative polarity of said high voltage which is applied to the cathode of said X-ray tube, said second voltage-multiplier device for delivering via a positive high-voltage output a positive polarity of said high voltage which is applied to the anode of said X-ray tube.

7. An assembly according to claim 6, wherein said step-up transformer delivers said intermediate alternating-current high voltage via a first output and a second output connected respectively to a first high-voltage input and to a second high-voltage input of each voltage-multiplier device aforesaid.

8. An assembly according to claim 7, wherein said second inputs of said first and second voltage-multiplier devices are connected to ground.

* * * * *